US005584752A

United States Patent [19]

Mizutani

[11] Patent Number: 5,584,752

[45] Date of Patent: Dec. 17, 1996

[54] GRINDING APPARATUS

[75] Inventor: Shigemitsu Mizutani, Kanagawa, Japan

[73] Assignee: Fuji Photo Film Co., Ltd., Kanagawa, Japan

[21] Appl. No.: 507,833

[22] Filed: Jul. 27, 1995

[30] Foreign Application Priority Data

Oct. 7, 1994 [JP] Japan ..... 6-243720

[51] Int. Cl.[6] ..... B24B 21/00

[52] U.S. Cl. ..... 451/296; 451/303; 451/310

[58] Field of Search ..... 451/296, 299, 451/303, 305, 306, 307, 310, 355

[56] References Cited

U.S. PATENT DOCUMENTS

| | | | |
|---|---|---|---|
| 3,488,891 | 1/1970 | Kissling | 451/307 |
| 3,691,580 | 9/1972 | Eggert . | |
| 4,662,116 | 5/1987 | Erani | 451/296 |
| 4,669,224 | 6/1987 | Armstrong et al. | 451/296 |
| 4,999,953 | 3/1991 | Kinugawa et al. | 451/305 |
| 5,251,404 | 10/1993 | Wasserbaech | 451/307 |
| 5,443,415 | 8/1995 | Shebanow et al. | 451/296 |

FOREIGN PATENT DOCUMENTS

| | | | |
|---|---|---|---|
| 447589 | 3/1948 | Canada | 451/310 |
| 1577596 | 6/1969 | France | B24B 27/00 |
| 60-9653 | 1/1985 | Japan | B24B 21/00 |

*Primary Examiner*—Bruce M. Kisliuk
*Assistant Examiner*—Eileen P. Morgan
*Attorney, Agent, or Firm*—Sughrue, Mion, Zinn, Macpeak & Seas

[57] ABSTRACT

A pair of supporting arms are rotatably attached to both ends of a fixed shaft. A supporting shaft extends across forward ends of the supporting arms and in parallel to the fixed shaft. A grinding roller on which an abrasive tape is arranged, and guide rollers sandwiching it are attached to this shaft. Axial centers of the grinding roller and the guide rollers are in an eccentric state. Thus when the guide rollers contact a color filter, a gap is given between the grinding roller and the color filter, and projections can be ground corresponding to the gap.

20 Claims, 7 Drawing Sheets

GRINDING APPARATUS

BACKGROUND OF THE INVENTION

1. Field of the Invention

The present invention relates to a grinding apparatus for removing surface projections on a member to be ground by using an abrasive member.

2. Description of the Related Art

A liquid crystal display (hereinafter referred to as "LCD") includes a polarizing film which is provided, for example, on a surface side of a liquid crystal. The polarizing film brightens or darknens in accordance with whether or not the light having transmitted through the liquid crystal transmits through the polarizing film, and thus an image is displayed. Such LCD includes a color filter which contains minute filter-components, of colors such as green, blue and red, arranged in a mosaic state. The color filter is arranged between the liquid crystal and the polarizing film. The light transmitting through the polarizing film is subjected to filtration so as to display a color image.

When projections or foreign matters adhere to a surface of a color filter and a gap is produced between a polarizing film and the color filter due to the projections or foreign matters, it is impossible for the polarizing film to shield unnecessary light. It therefore becomes impossible to clearly display an image, as well as to display a vivid color image. For this reason, the color filter used for color LCD should be prevented from minute projections or foreign matters on the surface.

The allowable range for surface projections on a color filter used for color LCD is generally considered to be not more than about 4 μm. It is necessary to remove projections or foreign matters larger than the above from the surface of the color filter. In this removal, since the surface of the color filter is soft, careful attention should be paid so as not to apply unnecessary external force, and thus the operation should be conducted precisely and certainly.

An apparatus for automatically grinding a surface of a color filter as described above includes one in which the surface of the color filter is examined by using a laser length measuring machine or the like, the position and the height of projections are calculated, and then the projections are ground on the basis of a calculation result by using an abrasive member to be not more than a predetermined size.

However, such an automated grinding apparatus is exquisite, has a complicated structure, and is extremely expensive. For this reason, the operation for grinding the surface of the color filter is conducted in a conventional manner. Namely, a method is generally adopted in which an operator visually examines whether or not large projections or foreign matters are present on the surface of the color filter, and when large projections or foreign matters are found, they are ground and removed manually little by little by using an abrasive member such as an abrasive tape with abrasive particles. Therefore, careful attention is required.

SUMMARY OF THE INVENTION

An object of the present invention is to provide a grinding apparatus in which a surface of a member to be ground such as a color filter is ground to easily and certainly remove projections and so on.

Another object of the present invention is to provide a grinding apparatus which has a relatively simple structure.

The grinding apparatus according to the main embodiment of the present invention comprises a grinding stand, and a grinding unit which can approach and separate from a surface of a member to be ground placed on the grinding stand, for grinding the member to be ground by making relative movement in directions along the surface of the member to be ground, wherein the grinding unit comprises:

a fixed shaft arranged substantially in parallel to an upper surface of the grinding stand;

at least one supporting arm rotatably provided on the fixed shaft;

a supporting shaft supported to the supporting arm to be substantially parallel to the fixed shaft;

a grinding roller rotatably supported by the supporting shaft and having its circumferential surface on which an abrasive member is capable of being arranged; and a pair of guide rollers rotatably supported by the supporting shaft, with the grinding roller intervening therebetween;

the supporting shaft supporting the grinding roller and the guide rollers in a state in which their axes are not coaxial.

In the grinding apparatus according to the present invention, the grinding roller together with the guide rollers is allowed to approach the surface of the member to be ground by rotating the supporting arm around the fixed shaft. When the supporting shaft held to the supporting arm is rotated, the guide rollers and the grinding roller provided eccentrically make relative upward or downward movement, so that the guide rollers are allowed to protrude from the grinding roller by a desired amount.

Thus a desired gap is produced between The circumferential surface of the grinding roller and the surface of the member to be ground, in a state in which the guide rollers contact the surface of the member to be ground. The surface of the member to be ground can be ground in accordance with the size of the gap. Since the supporting arm is rotatably arranged with respect to the fixed shaft, the grinding roller and the pair of guide rollers can make upward or downward movement in response to a surface inclination of the member to be ground.

An embodiment of the present invention further comprises a supporting means for supporting the supporting arm at a position where the guide rollers and the grinding roller are separated from the surface of the member to be ground, and for rotating the supporting arm about the fixed shaft by canceling the support to allow the grinding roller together with the pair of guide rollers to approach the surface of the member to be ground.

In this aspect, when the supporting means is in the non-supporting state, the supporting arm rotates about the fixed arm, so that the grinding roller together with the pair of guide rollers can approach the surface of the member to be ground.

Another embodiment of the present invention resides in that the grinding apparatus according to the main embodiment, wherein a pair of the supporting arms are provided at both ends of the supporting shaft, and the fixed shaft and the supporting shaft are inserted into and supported by bearings provided at both ends of the supporting arms.

Thus the supporting shaft can be inclined with respect to the surface of the grinding stand, so that the guide rollers can be moved upwardly or downwardly in response to an inclination of the surface of the member to be ground.

Still another embodiment of the present invention resides in that the grinding apparatus according to the above embodiment, wherein self-aligning bearings are used as the bearings between the supporting arms and the supporting shaft.

In the embodiment, the supporting shaft can be swung by the self-aligning bearings so as to make is very easy that a pair of the guide rollers move upward and downward in repsonse to inclination of the surface of the memebr to be gournd. In such a manner, the grinding roller together with the pair of guide rollers is allowed to make upward or downward movement in response to an inclination of the surface of the member to be ground. Thus even if the surface of the member to be ground is inclined, it can be ground in an appropriate state.

DESCRIPTION OF THE PREFERRED EMBODIMENTS

An automatic grinding apparatus according to an embodiment of the present invention will be explained with reference to the drawings.

Figure 1:
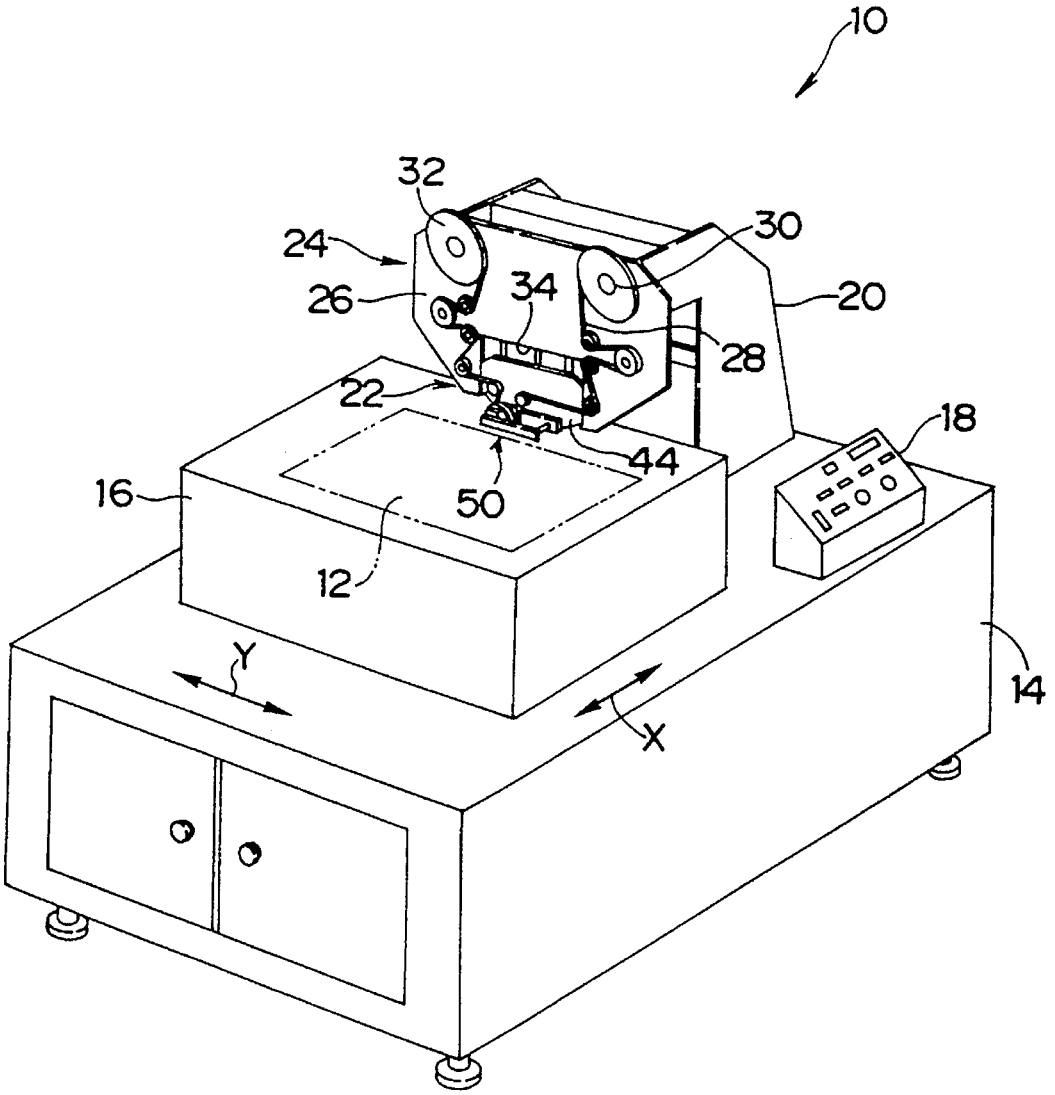
FIG. 1 is a perspective view showing a grinding apparatus according to one embodiment of the present invention.

As shown in FIG. 1, the automatic grinding apparatus 10 includes a grinding stand 16, an operation panel 18, and an arm 20 which are arranged on an upper surface of a pedestal 14. The arm 20 stands upright at one end of the pedestal 14, and has its forward end which Is bent to extend over the grinding stand 16. A grinding unit 24 equipped with a grinding head 22 is attached to the forward end. The grinding stand 16 can be freely moved in a longitudinal direction of the apparatus (direction of an arrow Y) and in a widthwise direction of the apparatus (direction of an arrow X) by means of a horizontal movement means (not shown). The side at which the operation panel 18 is mounted, in the direction of the arrow Y, provides a front side in the automatic grinding apparatus 10. An arrow Z indicates a vertical direction of the apparatus in each of the figures described below.

The automatic grinding apparatus 10 is used to grind a surface of a color filter 12 placed, as a member to be ground, at a predetermined position on the grinding stand 16. A suction groove (not shown) is formed on the surface of the grinding stand 16, so that the color filter 12 may be attracted and held by a negative pressure supplied to the suction groove. A light source for illumination (not shown) is provided inside the grinding stand 16. The light irradiated from the light source transmits through the color filter 12, and irradiates a grinding area of the color filter 12.

The grinding unit 24 attached to the forward end of the arm 20 includes a base plate 26 on which a tape roll 30 is arranged. An abrasive tape 28 as a grinding member is wound therearound in a roll shape. An intermediate portion of the abrasive tape 28 drawn from the tape roll 30 is applied to and wound around a grinding roller 58 of the grinding head 22 as described below, and a forward end portion of the tape 28 is wound around a winding roll 32. The winding roll 32 and the tape roll 30 are respectively connected to a tape winding means (not shown). The abrasive tape 28 fed from the tape roll 30 is used to grind the surface of the color filter 12, and then it is wound around the winding roll 32.

The abrasive tape 28 has a thickness of about 30 μm (+/– about 6 μm). The thickness is different depending on each roll. However, it is finished to have a constant thickness in a single roll and have fine abrasive particles compounded therein. This embodiment is designed to remove projections or foreign matters of not less than about 3–4 μm from the surface of the color filter 12 by using the abrasive tape 28. Projections or foreign matters of not less than about 3–4 μm are found beforehand visually or by other ways on the surface of the color filter 12. Places at which they are found are marked as faulty places, after which the color filter 12 is placed at a predetermined position on the grinding stand 16 to perform a grinding operation. In the automatic grinding apparatus 10, a switching operation at the operation panel 18 is conducted to move the grinding stand 16 in the X–Y directions and allow the faulty places on the color filter 12 to oppose the grinding head 22.

Figure 2:
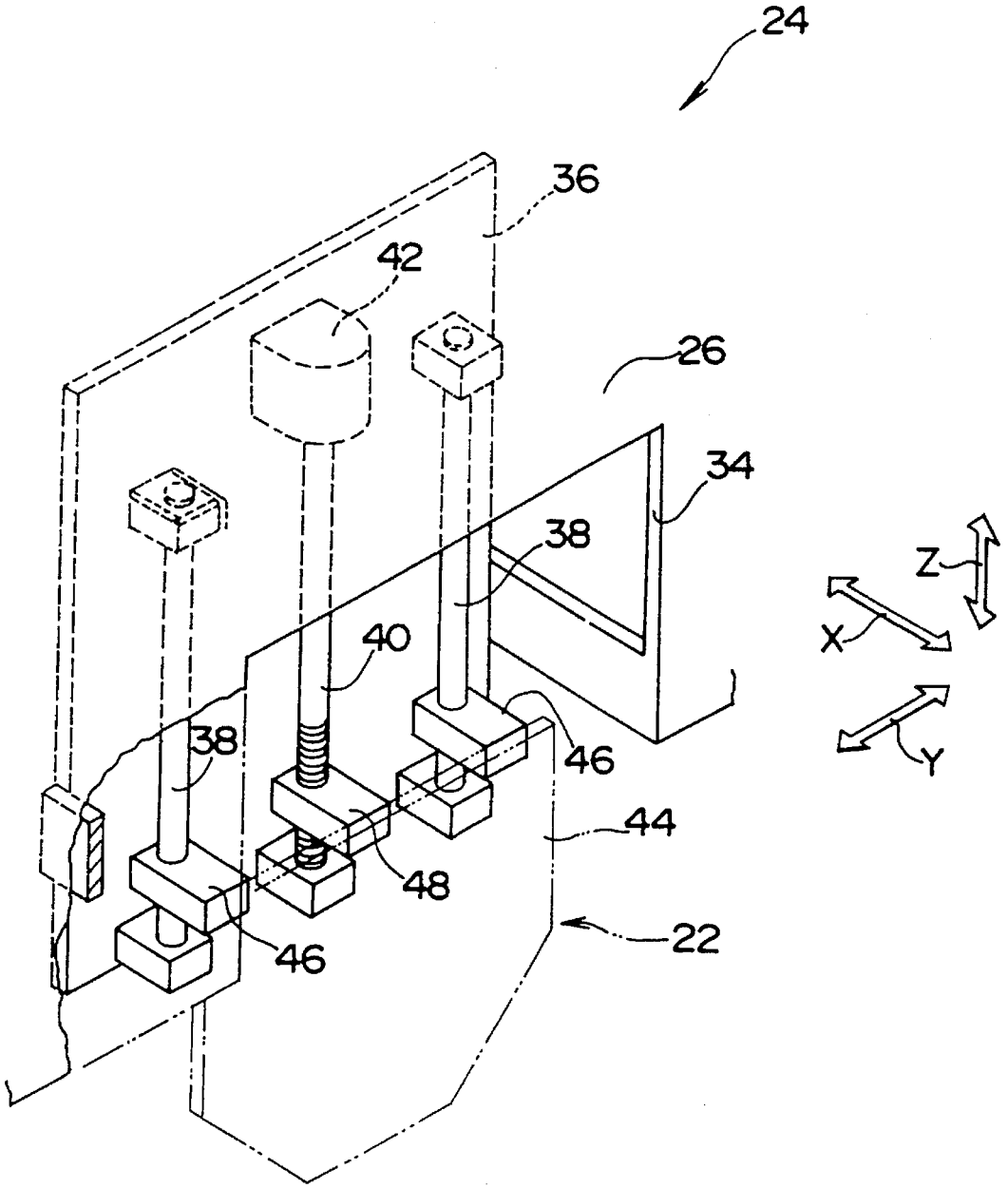
FIG. 2 is a perspective view of important parts in the vicinity of a grinding head of a grinding unit.

FIG. 2 shows the vicinity of the grinding head 22 of the grinding unit 24. The base plate 26 of the grinding unit 24 has a cut-out 34 formed at its center. An auxiliary plate 36 is attached at the inner side of the cut-out 34. A pair of guide rods 38, and a drive shaft 40 between the pair of guide rods 38 are respectively attached to the auxiliary plate 36 in parallel in the vertical direction. The drive shaft 40 is formed with a feed screw, and is rotatably supported. Its upper end is connected to an elevating motor 42.

Slide blocks 46 slidably inserted through the pair of guide rods 38, and a movable block 48 engaged with the drive shaft 40 are attached to a head base 44 of the grinding head 22, which is connected to the base plate 26 movably vertically through the slide blocks 46 and the movable block 48. In this arrangement, when the drive shaft 40 is driven and rotated by driving the elevating motor 42, the movable block 48 makes relative movement in the vertical direction to raise or lower the head base 44.

A swing arm 50 is arranged on the head base 44 of the grinding head 22. FIGS. 3 to 6 show the grinding head 22 and the swing arm 50 provided on the grinding head 22.

As shown in FIGS. 3 to 6, with respect to the swing arm 50, a fixed shaft 52 is provided on the head base 44 to protrude in parallel to the upper surface of the grinding stand 16. First ends of a pair of supporting arms 54 are rotatably attached to the fixed shaft 52. A supporting shaft 56 rotatably extends across second ends of the pair of supporting shaft 54 substantially in parallel to the fixed shaft 52.

Figure 6:
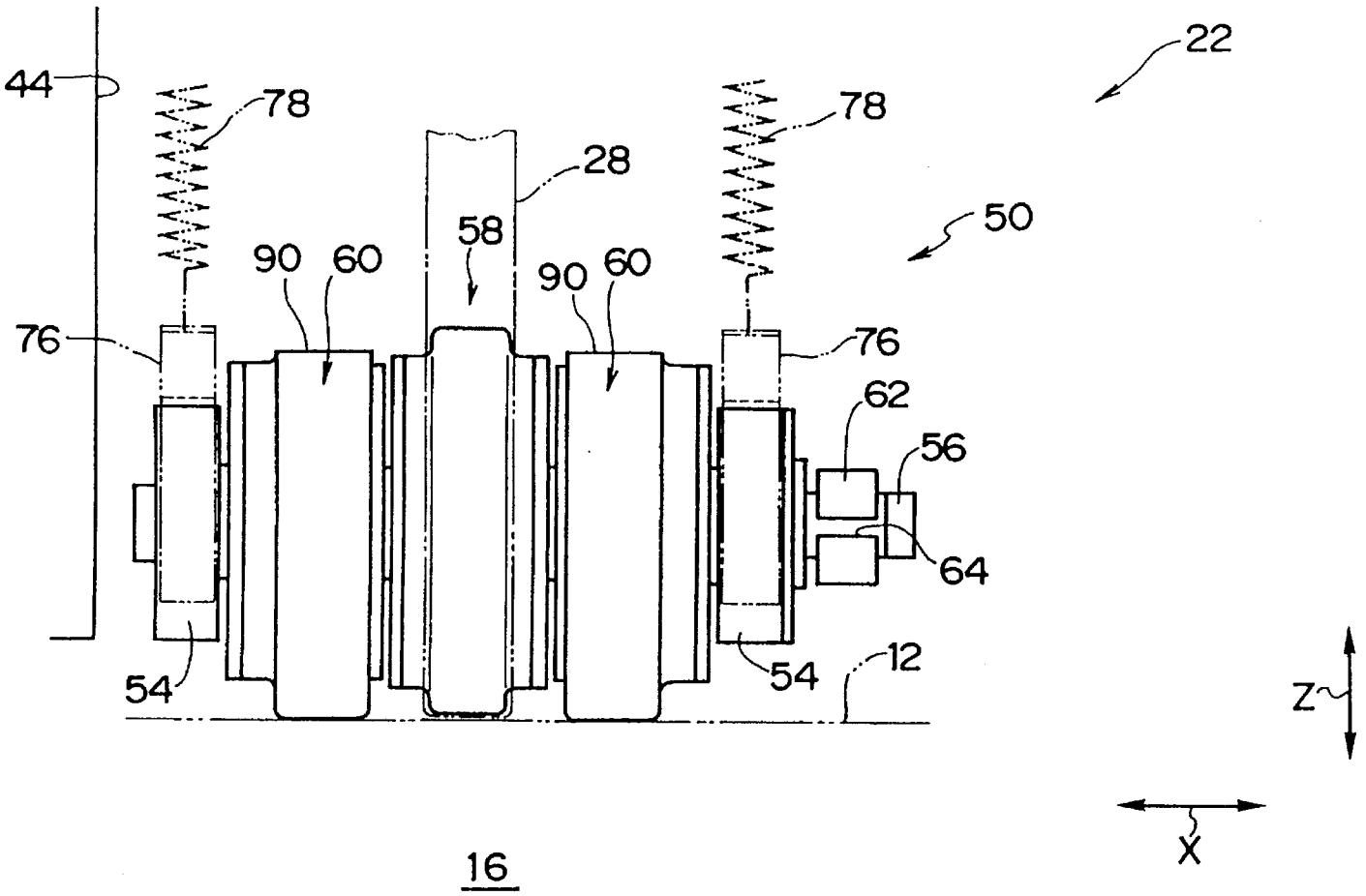
FIG. 6 is a schematic view of the swing arm of the grinding head as viewed from a back side of the apparatus.

A grinding roller 58, and a pair of guide rollers 60 which sandwich the grinding roller 58 are rotatably attached to the supporting shaft 56. The grinding roller 58 has substantially the same external diameter size as those of the guide rollers 60. An intermediate portion of the abrasive tape 28 drawn from the tape roll 30 (see FIG. 1) is applied to and wound around the grinding roller 58. As shown in FIG. 6. The central portion of the grinding roller 58 is narrower in width than a width size of the abrasive tape 28.

Figure 5:
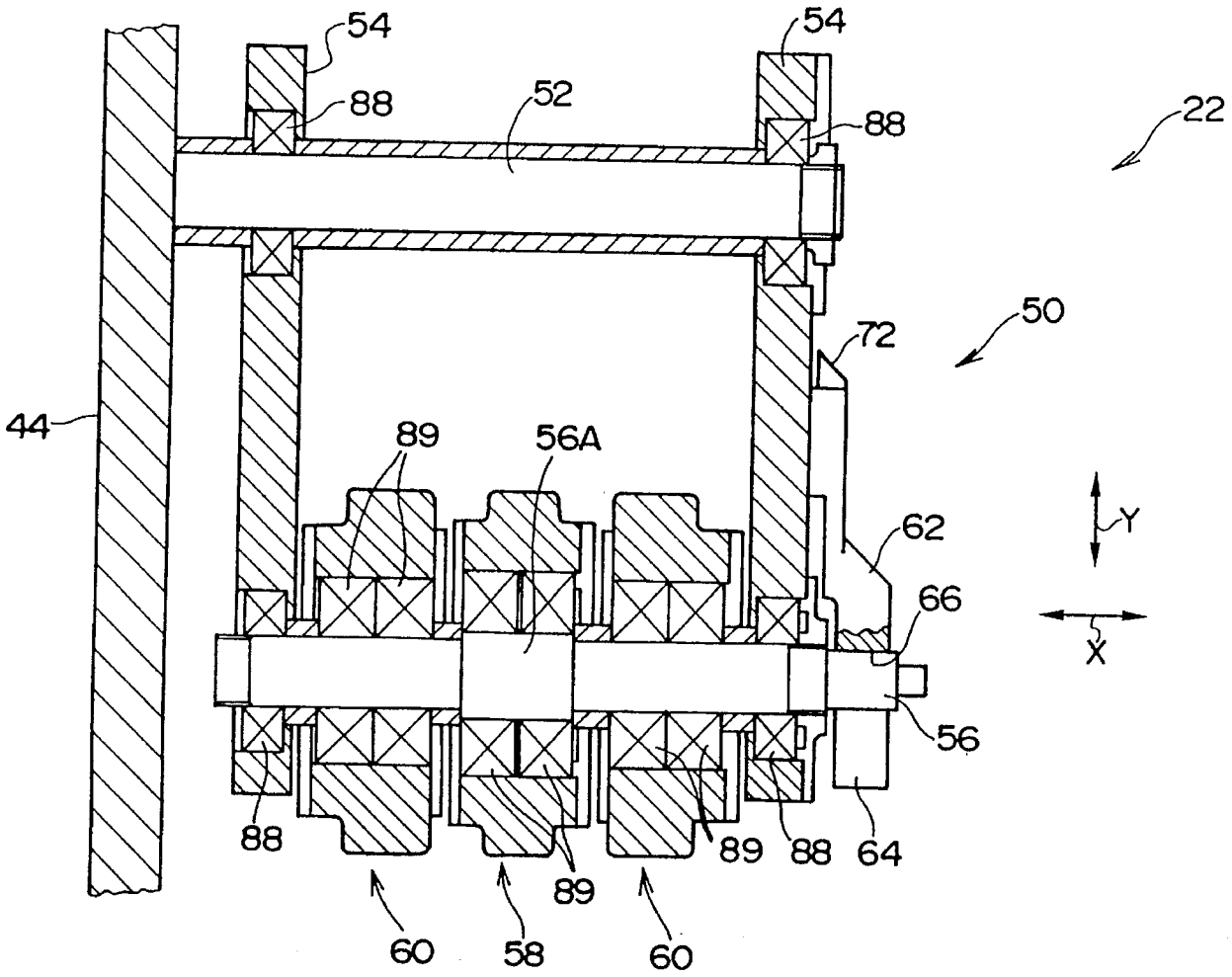
FIG. 5 is a schematic cross-sectional view taken along a line 5—5 in FIG. 4.

As shown in FIG. 5, an eccentric portion 56A, which has an axis that is not coaxial with common axes of both ends, is formed at an intermediate portion of the supporting shaft 56. The grinding roller 58 is attached to the eccentric portion 56A, and the guide rollers 60 are respectively arranged on both sides of the eccentric portion 56A. Namely, the grinding roller 58 is attached eccentrically with respect to the pair of guide rollers 60.

A rotatable lever 62 is arranged on one supporting arm.

Figure 3:
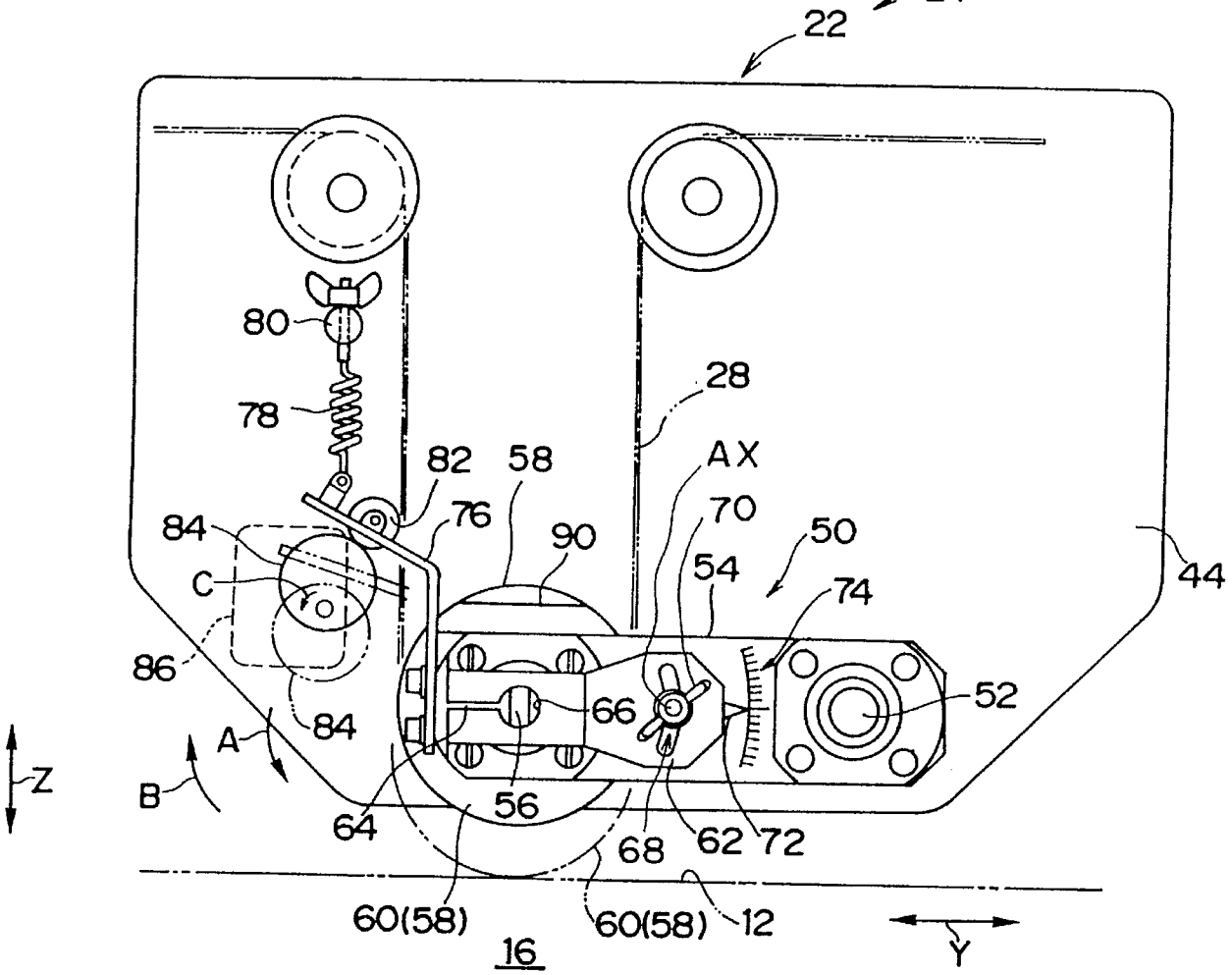
FIG. 3 is a schematic side view of the grinding head as viewed in a widthwise direction of the apparatus.
Figure 4:
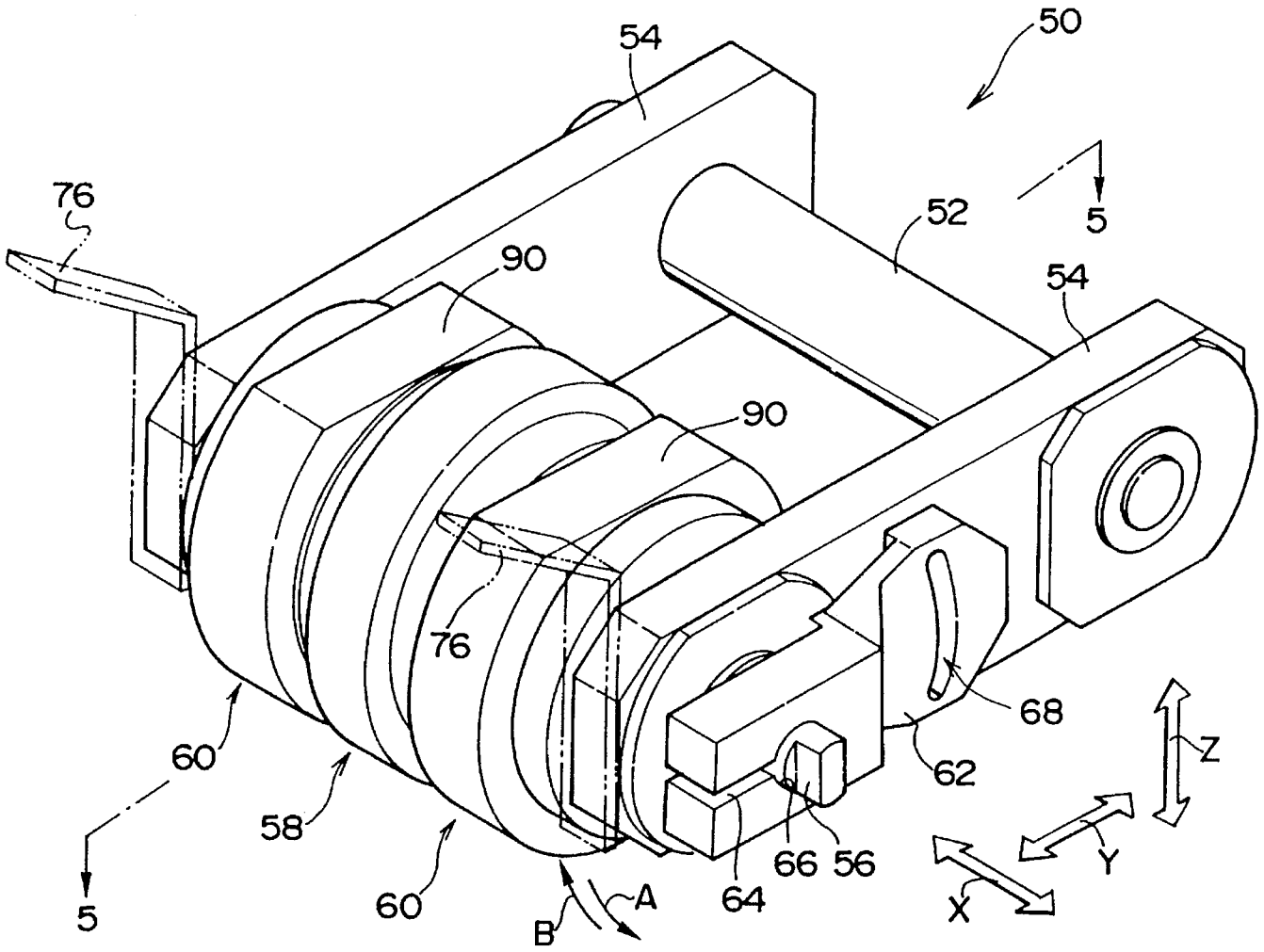
FIG. 4 is a schematic perspective view of a swing arm provided on the grinding head.

As shown in FIGS. 3 and 4, a forward end of the supporting shaft 56 which protrudes outwardly from the supporting arm 54 is forcedly inserted and connected to one end of the rotatable lever 62. Thus the supporting shaft 56 and the rotatable lever 62 integrally rotate about an axis AX as a center. The supporting shaft 56 is forcedly inserted into a through-hole 66 by enlarging the width of a cut-out 64 formed at one end of the rotatable lever 62. The cut-out 64 may be narrowed by tightening upper and lower parts thereof with a screw or the like.

The rotatable lever 62 extends along the supporting arm 54. An elongated hole 68 is perforated, in a shape of a circular arc substantially coaxially with the supporting shaft 56, near an end opposite to the supporting shaft 56. A screw hole (not shown) opposing to the elongated hole 68 is perforated in the supporting arm 54.

Accordingly, the rotatable lever 62 can be attached to the supporting arm 54 by screwing a thumbscrew 70 inserted into the elongated hole 68 into the screw hole (not shown) provided in the supporting arm. Thus the supporting shaft 56 can be fixed so as not to make rotation.

With respect to the swing arm 50, the protruding amount of outer circumferential ends of the guide rollers 60 from the grinding roller 58 can be changed by rotating the supporting shaft 56, together with the rotatable lever 62, about the axis AX. Namely, the grinding roller 58 arranged on the eccentric portion 56A of the supporting shaft 56 rotates eccentrically in accordance with the rotation of the supporting shaft 56, and thus the amount of discrepancy (height difference) between the outer circumferential end of the grinding roller 58 and the outer circumferential ends of the guide rollers 60 can be changed, depending on a rotation position.

Accordingly, as shown in FIG. 6, the gap between the circumferential surface of the grinding roller 58 and the surface of the color filter 12 can be controlled when the guide rollers 60 are allowed to abut against the surface of the color filter 12 on the grinding stand 16. The gap can be constantly maintained by holding or fixing the rotatable lever 62 to the supporting arm 54. In this embodiment, the height of the gap between the circumferential surface of the grinding roller 58 and the surface of the color filter 12 when the guide rollers 60 are allowed to abut against the surface of the color filter 12, (that is, the amount of discrepancy between the circumferential ends of the guide rollers 60 and the circumferential end of the grinding roller 58), is set to be a sum of a thickness of the abrasive tape 28 (about 30 μm) and an allowable range of the height of projections on the surface of the color filter 12 (about 3–4 μm). Allowable projections, which will not be ground, can be decided by controlling the amount of the discrepancy.

As shown in FIG. 3, a pointer 72 is provided at the end of the rotatable lever 62 opposite to the end near the supporting shaft 56. A scale 74 opposing to the pointer 72 is indicated on a side surface of the supporting arm 54. The apparatus is previously formed so that the amount of discrepancy between the grinding roller 58 and the guide rollers 60 is changed by 1 μm by rotating the rotatable lever 62 in an amount of one scale unit.

A pair of brackets 76 with their first ends extending substantially upwardly are attached to the ends, near the supporting shaft 56, of the pair of supporting arms 54. First ends of coil springs 78 are fastened to the upwardly extended forward end of each brackets 76. Second ends of the coil springs 78 are fastened to a pin 80 provided to protrude from the head base 44. The coil springs 78 urge the swing arm S0 to rotate about the shaft 52 in a direction so as to separate the grinding roller 58 and the guide rollers 60 from the grinding stand 16 (upwardly). The urging force of the coil springs 78 is slightly weaker than the rotational force for allowing the swing arm 50 to rotate toward the grinding stand 16 due to the weight of the guide rollers 60 and so on.

Thus the swing arm 50 Is urged upwardly by the urging force of the coil springs 78 when the guide rollers 60 are allowed to abut against the surface of the color filter 12. A light weight (for example, about 100 g) merely acts on the surface of the color filter 12. Accordingly, the surface of the color filter 12 can be prevented from damage which may be caused by the action of an excessive weight partially exerted on the surface of the color filter 12.

A small roller 82 is rotatably attached to the bracket 76, at the side of the head base 44. The small roller 82 has its outer circumference which protrudes downwardly from the bracket 76. An eccentric cam 84 is provided on the head base 44 as an elevating means for the swing arm 50. The circumferential surface of the eccentric cam 84 abuts against the circumferential surface of the small roller 82 protruding downwardly from the bracket 76. The eccentric cam 84 rotates eccentrically in a direction of an arrow C by means of a driving force of a motor 86. Thus the bracket 76 makes upward or downward movement together with the small roller 82 abutting against the eccentric cam 84, and the swing arm 50 rotates in directions of arrows A and B around the fixed shaft 52 as an axis.

The grinding roller 58 can be retracted upwardly together with the guide rollers 60 by the rotation of the awing arm 50 in the direction off the arrow B around the fixed shaft 52, or the guide rollers 60 can be moved downwardly together with the grinding roller 58 to abut against the surface of the color filter 12 on the grinding stand 16 by the rotation of the swing arm 50 in the direction of the arrow A.

Namely, with respect to the grinding unit 24, the grinding head 22 is moved downwardly by driving the elevating motor 42, thereafter the motor 86 is driven to rotate the swing arm 50, and the guide rollers 60 together with the grinding roller 58 are allowed to abut against the color filter 12 on the grinding stand 16. Thus the surface of the color filter 12 can be ground by using the abrasive tape 28 applied to and wound around the grinding roller 58.

As shown in FIG. 5, self-aligning bearings 88 are provided as bearings between the fixed shaft 52 and the supporting arms 54 and between the supporting shaft 56 and the supporting arms 54. The self-aligning bearings 88 can rotatably support axes of the supported shafts, even in a fluctuating state, provided that a predetermined range is not exceeded.

Thus in the swing arm 50, each of the both ends of the supporting shaft 56 can make upward or downward movement separately. Therefore, when a difference in height is produced for contact positions of the pair of guide rollers 60 due to, for example, nonuniformity of thickness of the color filter 12, the supporting shaft 56 can be inclined with respect to the surface of the grinding stand 16 so that each of the guide rollers 60 is raised or lowered in response to the difference in height. Pairs of angular contact ball bearings 89

(two-for each) are respectively arranged for the guide rollers 60 and the grinding roller 58 between the supporting shaft 58 and them so that no fluctuation of the rotational axis occurs.

As shown in FIGS. 3 and 4, flat portions 90 are formed on the guide rollers 60 by cutting a part of the outer circumferential portion thereof. The guide rollers 60 are balanced owing to the formation of the flat portions 90 such that the flat portions 90 are always on the upper side, and the outer circumferential portions on the side opposite to the flat portions 90 sandwiching the axial centers are always on the lower side when the guide rollers 60 are separated from the surface of the color filter 12. Thus the guide rollers 60 are allowed to contact the surface of the color filter 12 at constant positions of the outer circumferential portions of the rollers 60 (at the side opposite to the flat portions 90) even if the axes of the pair of guide rollers 60 are slightly deviated. Accordingly, the substantial amount of discrepancy between the rollers 60 and the grinding roller 58 does not change.

The automatic grinding apparatus 10 permits grinding, In a state in which the guide rollers 60 abut against the surface of the color filter 12, so that the grinding stand 16 is moved by a constant amount along the direction of the arrow Y on the proximal side of the apparatus while relatively moving the abrasive tape 28 in an opposite direction. Accordingly, the guide rollers 60 abut against the surface of the color filter 12 and rotate. When the swing arm 50 is subsequently raised, the guide rollers 60 rotate and return so that the flat portions 90 are on the upper side.

Next, the operation of this embodiment will be explained.

Upon the use of the automatic grinding apparatus 10, the tape roll 30 is installed to the base plate 26 of the grinding unit 24, and the abrasive tape 28 drawn from the tape roll 30 is applied to and wound around the grinding roller 58 of the swing arm 50 provided on the grinding head 22. The color filter 12 to be subjected to grinding is subsequently placed and held at a predetermined position on the grinding stand 16. A region of the color filter 12 to be ground is opposed to the grinding head 22, and then the grinding operation is performed.

At this time, considering a thickness of the abrasive tape 28 and a finished state of the color filter 12, the rotatable lever 62 is used to control the amount of discrepancy between the grinding roller 58 and the guide rollers 60. In this situation, the grinding roller 58 is arranged eccentrically with respect to the guide rollers 60, and the scale 74 is provided on the supporting arm 54 of the swing arm 50. Thus the amount of discrepancy can be easily controlled corresponding to the thickness of the abrasive tape 28 and a desired finished state.

In the automatic grinding apparatus 10, when the start of the grinding operation is inputted by a switching operation at the operation panel 18, the elevating motor 42 is driven to lower the grinding head 22 to a predetermined height with respect to the surface of the grinding stand 16, and it is stopped. Next, the motor 86 is driven to rotate the eccentric cam 84, the guide rollers 60 are lowered together with the grinding roller 58 around which the abrasive tape 28 is wound, and the guide rollers 60 are allowed to abut against the surface of the color filter 12. Thus a gap is formed between the abrasive tape wound around the grinding roller 58 and the color filter 12 in accordance with an allowable range for the height of projections on the surface of the color filter 12.

The swing arm 50 having been lowered as described above has its forward end urged upwardly by the coil springs 78, so that the surface of the color filter 12 receives a small load through the guide rollers 60. Accordingly, the color filter 12 is not damaged by the load given by the guide rollers 60.

In this state, the grinding stand 16 is subsequently moved to relatively move the color filter 12 with respect to the grinding roller 58. The abrasive tape 28 is drawn from the tape roll 30, while the abrasive tape 28 is wound by the winding roll 32. Thus the abrasive tape 28 moves at a predetermined relative speed with respect to the surface of the color filter 12. When projections having a height of not less than an allowable range (for example, 4 μm or more) are present on the surface of the color filter 12 upon the relative movement of the abrasive tape 28 with respect to the surface of the color filter 12, the projections are ground and removed by the abrasive tape 28.

After one time of grinding is completed as described above, the motor 86 is driven to rotate the swing arm 50 upwardly, the guide rollers 60 are once separated from the surface of the color filter 12, and the next grinding operation is performed. In this case, when the guide rollers 60 are separated from the surface of the color filter 12, they rotate so that the flat portions 90 are on the upper side. Thus the same portions of the guide rollers 60 (the portions of the side opposite to the flat portions 90) are allowed to abut against the surface of the color filter 12, and the amount of discrepancy with respect to the grinding roller 58 can be constantly maintained.

Alternatively, upon completion of one time of the grinding operation, the grinding stand 16 and the abrasive tape 28 may be moved in directions opposite to those in the first grinding operation to conduct reciprocal grinding after winding some amount of the abrasive tape 28 around the winding roll 32 without raising the swing arm 50.

The swing arm 50 provided with the grinding roller 58 and the guide rollers 60 undergoes no limitation to the rotation in such a direction that the guide rollers 60 is separated from the surface of the grinding stand 16 (the direction of the arrow B). Accordingly, if the thickness of the color filter 12 changes and thus the height of the surface of the color filter 12 from the surface of the grinding stand 16 changes, the grinding roller 58 can be moved upwardly or downwardly together with the guide rollers 60, following the change unrestrictedly. Thus, the gap between the grinding roller 58 and the surface of the color filter 12 can be constantly maintained.

On the other hand, when the thickness of the color Filter 12 changes along a direction perpendicular to the grinding direction, if the supporting shaft 56 of the swing arm 50 is held in parallel to the surface of the grinding stand 16, one of the guide rollers is lifted and raised. Thus, the height of the gap between the grinding roller 58 and the surface of the color filter 12 changes. If such a situation is given, it becomes impossible to grind the surface of the color filter 12 within allowable limitation.

On the contrary, in the automatic grinding apparatus 10 to which the present invention is applied, the self-aligning bearings 88 are arranged between the fixed shaft 52 and the supporting arms 54 and between the supporting shaft 56 and the supporting shafts 54 respectively, so that the both ends of the supporting shaft 56 are each independently movable upwardly and downwardly. Thus the supporting shaft 56 is inclined in response to the change in surface height of the color filter 12 when one of the guide rollers 60 starts to move upwardly in accordance with upward movement of the other guide roller 60. Accordingly, the former guide roller 60 is not lifted nor raised from the surface of the color filter 12, and the height of the gap between the surface of the color filter 12 and the circumferential surface of the grinding roller 58 (i.e., the surface of the abrasive tape 28) can be prevented from change.

In such a manner, the swing arm 50 can follow the change in the level of the surface of the color filter 12, and the pair of guide rollers 60 can respectively follow the change in the level of the surface of the color filter 12. Thus the surface of the color filter 12 can be always ground allowably.

In this embodiment, the self-aligning bearings 88 are respectively provided between the fixed shaft 52 and the supporting arms 54 and between the supporting shaft 56 and the supporting arms 54. However, the swing arm 50 can make swinging movement easily by providing the self-aligning bearings 88 at least between the supporting arms 54 and the supporting shaft 56. Although the supporting shaft 56 is held by the pair of supporting arms 54, a cantilever swing arm may be available in which only one supporting arm 54 is used to support the supporting shaft 56.

Even in such an arrangement, the grinding roller 58 and the guide rollers 60 are attached to the supporting shaft 56 is achieved so that the rotational axes of the grinding roller 58 and the guide rollers 60 do not fluctuate. By doing so, the grinding roller 58 can be used to uniformly grind the surface of the color filter 12.

Alternatively, the self-aligning bearings 88 are not used, but general roller bearings may be used. In general, the color filter 12 used for liquid crystal display devices has high flatness, and thus the inclination is slight when it is placed on the grinding stand 16. Accordingly, even when general roller bearings are used for the swing arm 50, and the supporting shaft 56 is allowed to make swinging movement within a range of fluctuation of axes of the roller bearings, the pair of guide rollers 60 can be respectively moved upwardly or downwardly following the inclination of the surface of the color filter 12. In this aspect, it is of course necessary to avoid fluctuation between the supporting shaft 56 and the following: grinding roller 58 and the guide rollers 60.

As described above, in the case of the automatic grinding apparatus 10 applied to this embodiment, even when inclination is generated due to the change in the surface level of the member to be ground such as the color filter 12, grinding operation can be uniformly conducted following the inclination and thus the grinding operation can be performed with extremely high accuracy.

This embodiment does not limit the construction of the grinding apparatus 10 to which the present invention is applied. For example, the grinding head 22 installed with the grinding tape 28 is allowed to approach the grinding stand 16 in this embodiment; however, the grinding stand 16 may be formed to be moved. In addition, the grinding stand 16 is moved in the direction opposite to the running direction of the abrasive tape 28 when the abrasive tape 28 is used to grind the surface of the color filter 12; however, the grinding head 22 may be moved without moving the grinding stand 16.

The grinding roller 58 has substantially the same diameter as those of the guide rollers 60; however, they may have different external diameter sizes.

Figure 7:
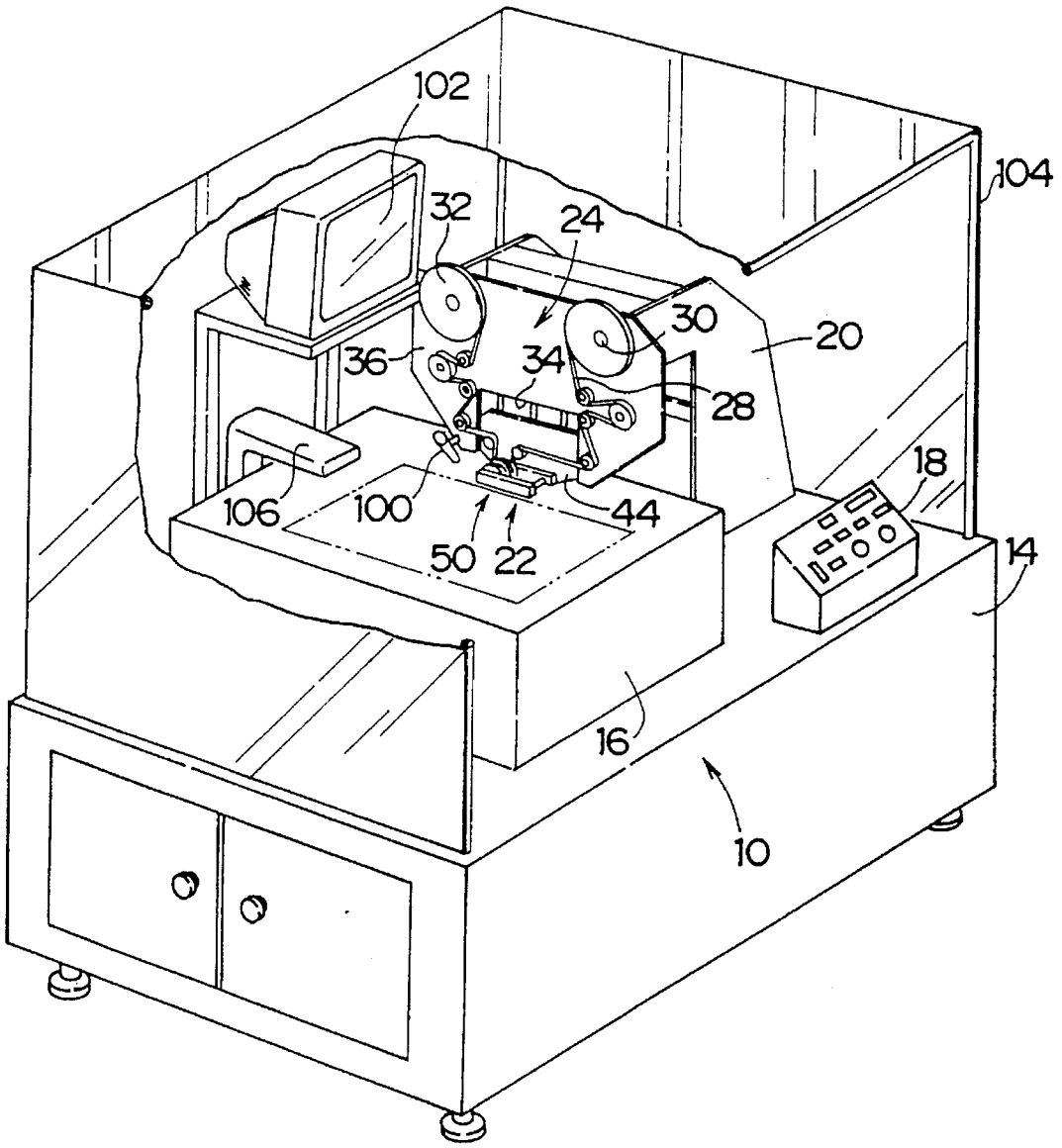
FIG. 7 is a schematic perspective view showing one example of the grinding apparatus comprising added functions to conduct a smooth grinding operation.

Further, various functions can be added to the automatic grinding apparatus 10 applied to this embodiment. For example, as shown in FIG. 7, an image pickup device such as a camera 100 for photographing the surface of the grinding stand 16 to which the grinding head 22 opposes may be set on the grinding head 22, and a monitor 102 such as CRT may be provided over the grinding stand 16. The surface of the color filter 12 to be ground is thereby enlarged and displayed on the monitor 102. Thus minute configurations of the surface of the color filter 12 which, for example, is ground can be easily observed.

In addition, the surrounding of the automatic grinding apparatus 10 may be covered with a dust protective cover 104, and a blowing port 106 connected to a blower (not shown) may be provided on a back side of the apparatus. Air blowing onto the surface of the color filter 12 from the blowing port 106 can be used to exclude dust and so on deposited on the surface of the color filter 12 prior to the grinding operation. Fine dust generated by surface-grinding can be also discharged from the surface of the color filter 12. In this aspect, an aspirator opposing to the blowing port 106 may be provided to draw dust and so on excluded from the surface of the color filter 12. By adding such features, the grinding operation becomes easier, and it is also possible to smoothly conduct the grinding operation for the color filter 12 with good accuracy.

The grinding apparatus according to the present invention as described above is not limited to the use for the color filter 12, but it can be applied to grinding apparatuses which requires processing accuracy for planes in order To grind surfaces of, for example substrates for electronic circuits and high frequency circuits as a member to be ground.

What is claimed is:

1. A grinding apparatus comprising a grinding stand, and a grinding unit which can approach and separate from a surface of a member to be ground placed on the grinding stand, for grinding the member to be ground by making relative movement in directions along the surface of the member to be ground, wherein the grinding unit comprises:

a fixed shaft arranged substantially in parallel to an upper surface of the grinding stand;

at least one supporting arm rotatably provided on the fixed shaft;

a supporting shaft supported to the supporting arm to be substantially parallel to the fixed shaft;

a grinding roller rotatably supported by the supporting shaft and having its circumferential surface on which an abrasive member is capable of being arranged; and a pair of guide rollers rotatably supported by the supporting shaft, with the grinding roller intervening therebetween;

the supporting shaft supporting the grinding roller and the guide rollers in a state in which their axes are not coaxial.

2. The grinding apparatus according to claim 1, further comprising a stopper which is capable of allowing rotation of the supporting shaft about its axis, and holds the supporting shaft to the supporting arm at a predetermined position of the rotation.

3. The grinding apparatus according to claim 2, wherein the stopper is provided with an indicator for indicating information corresponding to a degree of eccentricity.

4. The grinding apparatus according to claim 1, further comprising a supporting means for supporting the supporting arm at a position where the guide rollers and the grinding roller are separated from the surface of the member to be ground, and for rotating the supporting arm about the fixed shaft by canceling the support to allow the grinding roller together with the pair of guide rollers to approach the surface of the member to be ground.

5. The grinding apparatus according to claim 1, wherein a pair of the supporting arms are provided at both ends of the supporting shaft, and the fixed shaft and the supporting shaft are inserted into and supported by bearings provided at both ends of the supporting arms.

6. The grinding apparatus according to claim 5, wherein self-aligning bearings are used as the bearings between the supporting arms and the supporting shaft.

7. The grinding apparatus according to claim 6, wherein self-aligning bearings are also used bewteen the fixed shaft and the supproting shaft.

8. The grinding apparatus according to claim 1, further comprising an image pickup device for photographing an abrasive member-facing portion of the member to be ground, and a display for displaying an image therefrom.

9. The grinding apparatus according to claim 1, which is covered with a dust protective cover, and further comprises at least one of a blower and an aspirator.

10. The grinding apparatus according to claim 1 for use in grinding at least one of a color filter, and a substrate for electronic circuits or high frequency circuits.

11. A grinding apparatus comprising a grinding stand, and a grinding unit which can approach and separate from a surface of a member to be ground placed on the grinding stand, for grinding the member to be ground by making relative movement in directions along the surface of the member to be ground, wherein the grinding unit comprises:

a fixed shaft arranged substantially in parallel to an upper surface of the grinding stand;

at least one supporting arm rotatably provided on the fixed shaft;

a supporting shaft supported to the supporting arm to be substantially parallel to the fixed shaft and having two shaft portions in which their axes are not coaxial;

a grinding roller rotatably supported by one shaft portion of the supporting shaft and having its circumferential surface on which an abrasive member is arranged;

a pair of guide rollers rotatably supported by the other shaft portion of the supporting shaft, with the grinding roller intervening therebetween; and an adjustment stopper which is capable of allowing rotation of the supporting shaft about its own axis, holds the shaft to the supporting arm at a predetermined position of the rotation thereby adjusting a separating distance between the grinding roller and the member to be ground when the guide rollers contact the member to be ground.

12. The grinding apparatus according to claim 11, wherein the stopper is associated with a scale corresponding to the separating distance.

13. The grinding apparatus according to claim 11, further comprising a supporting means for supporting the supporting arm at a position where the guide rollers and the grinding roller are separated from the surface of the member to be ground, and for rotating the supporting arm about the fixed shaft by canceling the support to allow the grinding roller together with the pair of guide rollers to approach the surface of the member to be ground.

14. The grinding apparatus according to claim 13, wherein the supporting means comprises an urging means connected to the supporting arm.

15. The grinding apparatus according to claim 11, wherein a pair of the supporting arms are provided at both ends of the supporting shaft, and the fixed shaft and the supporting shaft are inserted into and supported by bearings provided at both ends of the supporting arms.

16. The grinding apparatus according to claim 15, wherein self-aligning bearings are used as the bearings between the supporting arms and the supporting shaft.

17. The grinding apparatus according to claim 16, wherein self-aligning bearings are also used bewteen the fixed shaft and the supproting shaft.

18. The grinding apparatus according to claim 11, wherein the abrasive member is an abrasive tape.

19. A grinding apparatus comprising a grinding stand, and a grinding unit which can approach and separate from a surface of a member to be ground placed on the grinding stand, for grinding the member to be ground by making relative movement in directions along the surface of the member to be ground, wherein the grinding unit comprises:

a fixed shaft arranged substantially in parallel to an upper surface of the grinding stand;

at least one supporting arm rotatably provided on the fixed shaft;

a supporting shaft supported to the supporting arm to be substantially parallel to the fixed shaft and having two shaft portions in which their axes are not coaxial;

a grinding roller rotatably supported by one shaft portion of the supporting shaft and having its circumferential surface on which an abrasive member is arranged;

a pair of guide rollers rotatably supported by the other shaft portion of the supporting shaft, with the grinding roller intervening therebetween; and a rotatable lever which is capable of allowing rotation of the supporting shaft about its own axis, holds the shaft to the supporting arm at a predetermined position of the rotation thereby adjusting a separating distance between the grinding roller and the member to be ground when the guide rollers contact the member to be ground;

an urging means connected to the supporting arm directly or through a connecting member; and a movable unit for swinging the supporting arm or the connecting member and moving the supporting arm in a direction toward the surface of the grinding stand or in a direction to make separation from the surface.

20. The grinding apparatus according to claim 19, wherein the movable unit is an eccentric cam.

* * * * *